US006802504B2

(12) United States Patent
DePoi et al.

(10) Patent No.: US 6,802,504 B2
(45) Date of Patent: Oct. 12, 2004

(54) DIAGNOSTIC METHODOLOGY FOR AN INSERTING MACHINE

(75) Inventors: Arthur H. DePoi, Brookfield, CT (US); Shahzad H. Malick, Fairfield, CT (US); Gregory P. Skinger, Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 36 days.

(21) Appl. No.: 10/280,367

(22) Filed: Oct. 25, 2002

(65) Prior Publication Data

US 2004/0080100 A1 Apr. 29, 2004

(51) Int. Cl.[7] ..... B65H 7/02
(52) U.S. Cl. ..... 271/259; 271/258.04; 271/272
(58) Field of Search ..... 271/258.01, 259, 271/258.04, 272, 256

(56) References Cited

U.S. PATENT DOCUMENTS 4,249,080 A * 2/1981 Pritchett et al. ..... 250/557
5,622,364 A * 4/1997 Dutton et al. ..... 271/117
5,667,215 A * 9/1997 Yoshino ..... 271/258.01
5,934,661 A * 8/1999 Kameyama ..... 271/4.08
6,007,062 A * 12/1999 Choo et al. ..... 271/258.01
6,554,275 B1 * 4/2003 Tranquilla ..... 271/259
6,644,660 B2 * 11/2003 Sussmeier et al. ..... 271/270

* cited by examiner

*Primary Examiner*—David H. Bollinger
(74) *Attorney, Agent, or Firm*—Christopher J. Capelli; Angelo N. Chaclas

(57) ABSTRACT

The present invention relates to a system for providing diagnostic information relating to the performance of an inserter system having a roller arrangement for conveying a document in a linear direction and first and second sensors located in close proximity to the roller arrangement. Each of the sensors are operable to detect at least the presence of a leading edge of a document conveying in close proximity to each sensor. The control system of the inserter determines the time it takes for a leading edge of a document to convey from said first sensor to said second sensor and compares that time to a prescribed threshold time and provides diagnostic information based upon the measured times values.

5 Claims, 4 Drawing Sheets

DIAGNOSTIC METHODOLOGY FOR AN INSERTING MACHINE

FIELD OF THE INVENTION

The present invention pertains to the field of inserting machines. More particularly, the present invention pertains to monitoring the motion of sheets through a sheet handling device, such as a mailing or high-speed inserter to provide machine control diagnostics.

BACKGROUND OF THE INVENTION

A typical sheet or envelope handling device includes various structures, motors and sensors. For example, a typical envelope handling device includes an envelope feeding structure for feeding an envelope or a batch of envelopes in singular fashion in a downstream path of travel to a work station. Typical envelope handling devices employ ejection rollers or ejection belts operating at a constant speed, or at some speed that varies as a function of time, speeds chosen so as to avoid envelope collisions and noise. It is beneficial to control to a fine degree the motion of a sheet or envelope handling device so as to keep noise and undesirable motion of the sheets or envelopes to a minimum.

The prior art uses motion profiles to express, as a function of time, the velocity/speed of an axis of a motor that causes motion of a sheet in a mailing system. A motion profile consists of a series of segments, each segment having a duration and each corresponding to a state of motion of an axis of a motor ultimately responsible for imparting motion to a sheet or envelope.

For example, a motor may have an axis that in rotating pulls a sheet through part of a mailing system at a certain speed, after accelerating at a specified acceleration as a function of time, and concluding with some specified deceleration as a function of time. If the sheet does not slip, then the motion of the sheet can be correlated precisely with the motion of the axis of the motor: the sheet moves through the mailing system with a speed that is exactly equal to the speed of rotation of the part of the axis in contact with the sheet, i.e. usually the surface of a belt driven by the axis. In this case, commands are sometimes sent to a motor to impart motion to a sheet, for a series of time segments, based simply on the assumption that the motion of the axis of the motor causing the motion of the sheet can be equated to the motion of the sheet.

On occasion, however, a sheet in a sheet handling device will slip so that the motion of the axis does not necessarily indicate the motion of a sheet (or envelope). Then the motion of an axis of a motor can be conditioned based on receiving commands from sensors used to detect the presence of the sheet as it moves through the sheet handling device.

Typically, and even in such complex sheet handling machines, the operation of these machines is often categorized as simply working or not working without regard for how well the machine is operating, or more importantly, how close it is to failing. Hence there is a need to determine degraded performance in sheet handling machines and to predict likely failure of such a machine for the purpose of proactively adjusting and/or servicing the machine prior to experiencing machine failure. In the prior art, the diagnosis of sheet handling machine control problems was achieved through a combination of inferred cause and effect complied from the theory of how the sheet handling machine was supposed to operate. This prior art method is both imprecise and burdensome as machine problems were often identified after experience of a malfunction often causing damage to the documents being process in the sheet handling machine.

Therefore, it is an object of the present invention to provide a diagnostic methodology for sheet handling machines to continuously monitor and evaluate the operation of sheet handling machines during their operation and interpret collected data in real time to provide diagnostic information indicating as to how the machine is operating.

SUMMARY OF THE INVENTION

Accordingly, the present invention relates to a system for providing diagnostic information relating to the performance of an inserter system based upon data collected from documents conveying within the inserter system.

Preferably, it is the control system of the inserter system that is utilized to provide the diagnostic information. In use, the control system is preferably coupled to a roller arrangement in the inserter system utilized for conveying a document in a linear direction, with the control system being further coupled to first and second sensors located in close proximity to the roller arrangement. Each of the sensors are operable to detect at least the presence of a leading edge of a document conveying in close proximity to each sensor. The control system of the inserter determines the number of encoder counts (e.g., incremental rotational movements of a motor in the roller arrangement) it takes for a leading edge of a document to convey from said first sensor to said second sensor and compares the measured encoder counts to a prescribed number of encoder counts and provides diagnostic information based upon this comparison. In the event the diagnostic information reveals poor performance or possible malfunction is to occur in the inserter system, appropriate warning indicators are then provided to an operator of the inserter system.

BRIEF DESCRIPTION OF THE DRAWINGS

The above and other objects and advantages of the present invention will become more readily apparent upon consideration of the following detailed description, taken in conjunction with accompanying drawings, in which like reference characters refer to like parts throughout the drawings and in which.

DETAILED DESCRIPTION OF THE PREFERRED EMBODIMENT

Figure 1:
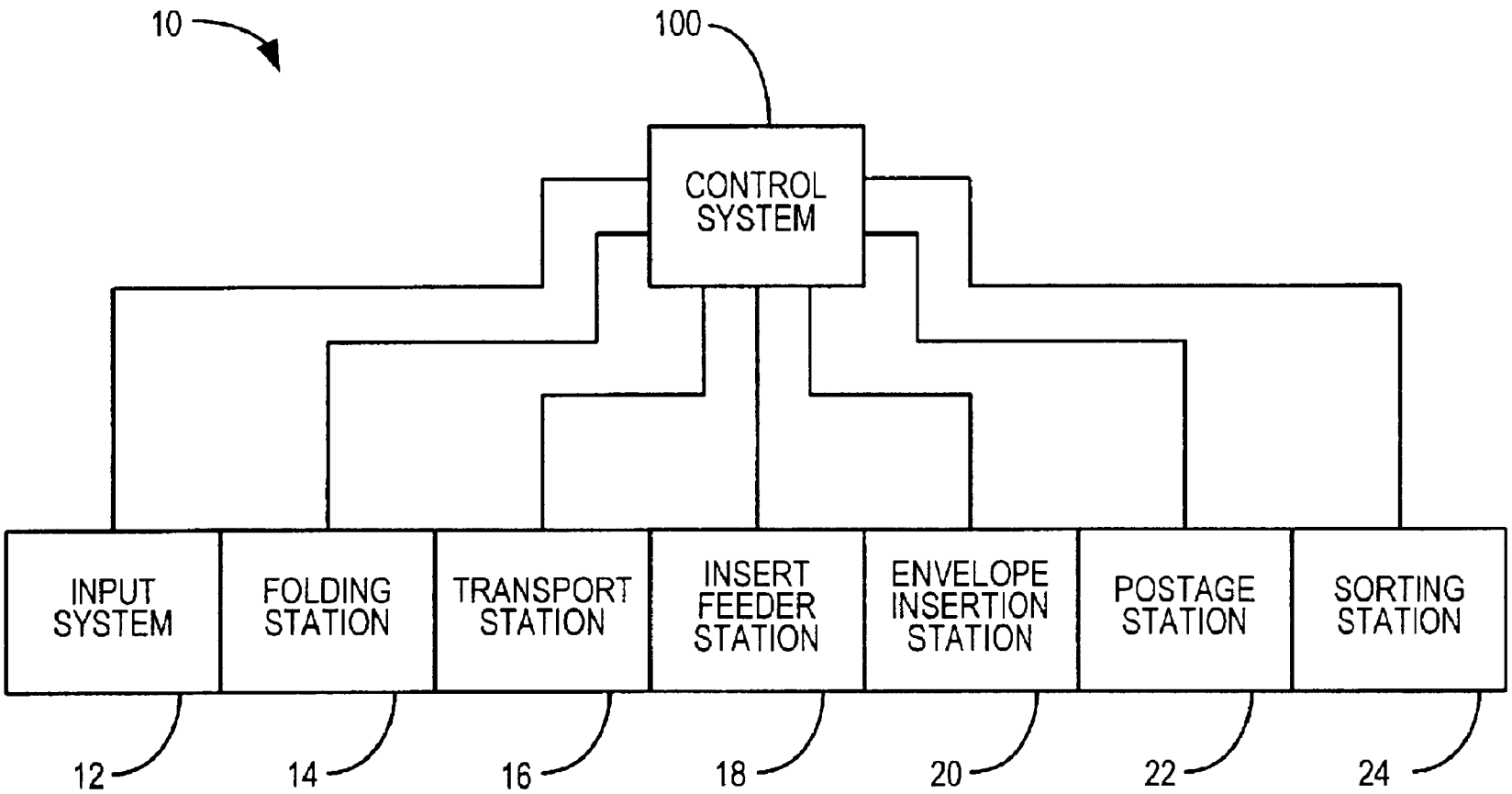
FIG. 1 depicts a block diagram of an inserter system that is the operating environment for the preferred embodiment of the present invention.

In describing the preferred embodiment of the present invention, reference is made to the drawings, wherein there is seen in FIG. 1 a schematic of a typical document inserting system, generally designated 10, which implements the present invention input system 100. In the following description, numerous paper handling stations implemented in inserter system 10 are set forth to provide a thorough understanding of the operating environment of the present invention. However it will become apparent to one skilled in the art that the present invention may be practiced without the specific details in regards to each of these paper-handling stations.

As will be described in greater detail below system 10 preferably includes an input system 12 that feeds paper sheets from a paper web to an accumulating station that accumulates the sheets of paper in collation packets. Preferably, only a single sheet of a collation is coded (the control document), which coded information enables the control system 100 of inserter system 10 to control the processing of documents in the various stations of the mass mailing inserter system. The code can comprise a bar code, UPC code or the like.

Essentially, input system 12 feeds sheets in a paper path, as indicated by arrow "a," along what is commonly termed the "main deck" of inserter system 10. After sheets are accumulated into collations by input system 12, the collations are folded in folding station 14 and the folded collations are then conveyed to a transport station 16, preferably operative to perform buffering operations for maintaining a proper timing scheme for the processing of documents in inserting system 10.

Each sheet collation is fed from transport station 16 to insert feeder station 18. It is to be appreciated that a typical inserter system 10 includes a plurality of feeder stations, but for clarity of illustration only a single insert feeder 18 is shown. Insert feeder station 18 is operational to convey an insert (e.g., an advertisement) from a supply tray to the main deck of inserter system 10 so as to be nested with the aforesaid sheet collation being conveyed along the main deck. The sheet collation, along with the nested insert(s) are next conveyed into an envelope insertion station 20 that is operative to insert the collation into an envelope. The envelope is then preferably conveyed to a postage station 22 that applies appropriate postage thereto. Finally, the envelope is preferably conveyed to a sorting station 24 that sorts the envelopes in accordance with postal discount requirements.

It is to be appreciated that the depicted embodiment of inserter system 10 implementing the present invention control system 100 is only to be understood as an example configuration of such an inserter system 10. It is of course to be understood that such an inserter system may have many other configurations in accordance with a specific user's needs.

As previously mentioned, inserter system 10 includes a control system 100 coupled to each aforesaid modular component of inserter system 10, which control system 100 controls and harmonizes operation of the various modular components implemented in inserter system 10. In accordance with the present invention, control system 100 is now adapted to preferably provide diagnostic information for each various modular component of inserter system 10. Specifically, and as will be described below, control system 100 continuously monitors and evaluates the operation of one or more modular components of an inserter system 10 during their operation and interprets collected data in real time to provide a machine operator with data as to how the inserter system 10 is operating as well as provide warning indications when appropriate.

Figure 2:
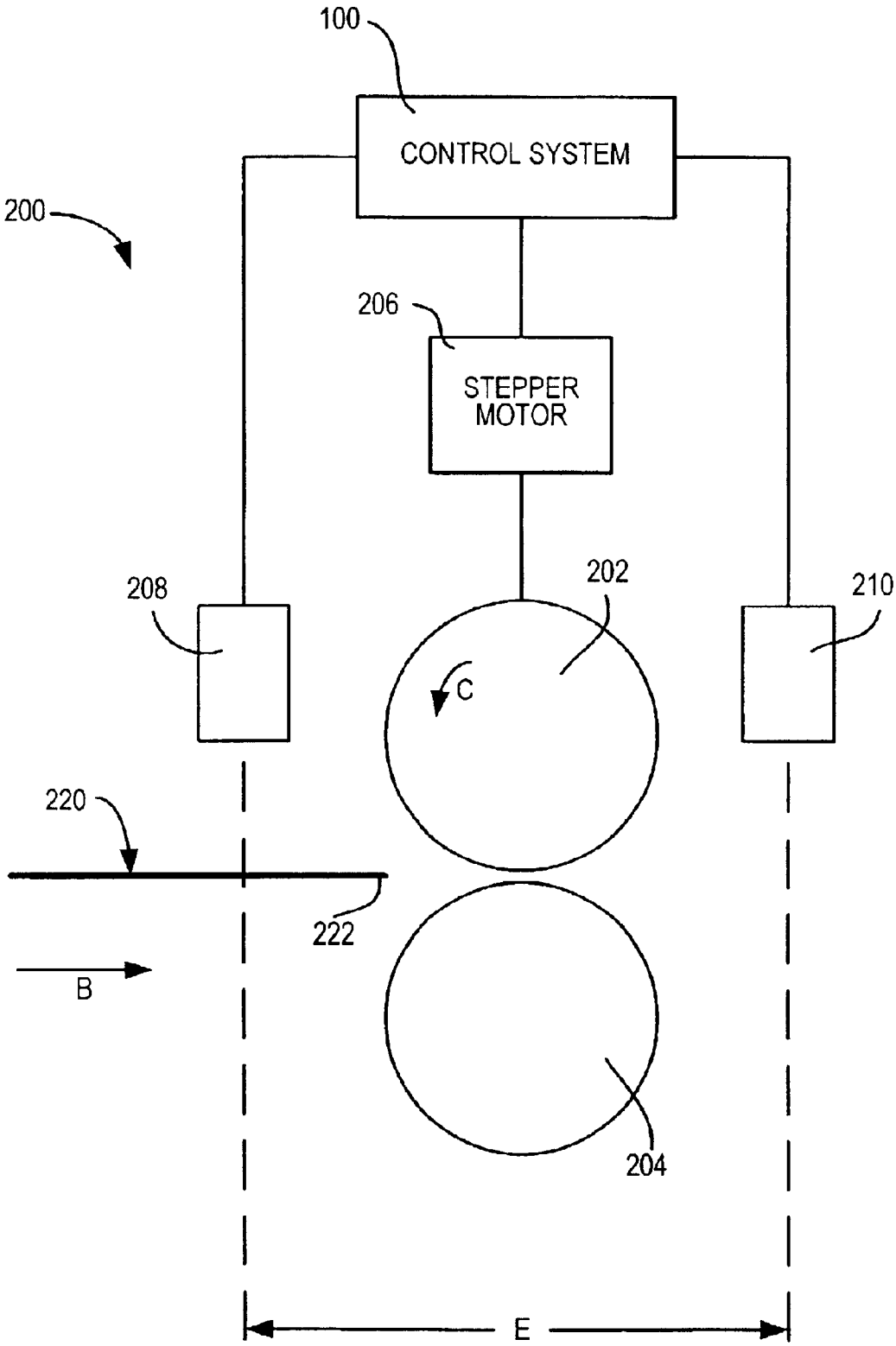
FIG. 2 is a simplified roller arrangement implementing the present invention diagnostic control system.

With reference now to FIG. 2, there is shown a typical roller arrangement, designated generally at 200, which is operable to convey a document 220 along the direction of travel indicated by arrow "B" in any one of the aforesaid modular components of inserter system 10. Roller arrangement includes a drive roller 202 and an associated driven roller 204. Connected to drive roller 202 is preferably a servo motor 206, which is coupled to control system 100. As is well known, servo motor 206 causes the incremental rotation of drive roller 202 (along the direction of arrow "C") wherein each incremental rotation corresponds to an encoder pulse of stepper motor 206. In the present invention, each encoder pulse of stepper motor 206 is monitored by control system 100. It is also to be appreciated that the present invention is not to be understood to be limited to use of servo motors 206, but rather may be utilized with any type of motor that has an encoder feed (e.g., stepper motors) or a motor coupled to a position encoder that similarly corresponds incremental rotation of the motor into encoder counts, which encoder counts are monitored by control system 100.

Roller arrangement 200 further preferably includes first and second sensors 208, 210, which sensors are preferably optical sensors for detecting the passage of a document in proximity to the sensor. Sensors 208 and 210 are not to be limited to optical sensors but rather may encompass any type of sensor capable of detecting passage of a document. Each sensor 208 and 210 is coupled to control system 100 to provide feedback to control system 100.

It is further to be appreciated that this exemplary roller arrangement 200 may be implemented in any portion, or modular component of an inserter system 10 in which a document conveys between two fixed reference points (e.g., sensors 208 and 210). And, the present invention may be used to monitor a specific portion of an inserter system 10 (e.g., a sheet feeder) or may be used to simultaneously monitor a plurality of different portions of an inserter system 10, wherein each portion of the inserter system 10 would have a similar type of roller arrangement 200 coupled to the control system 100 of the inserter system 10.

Figure 3:
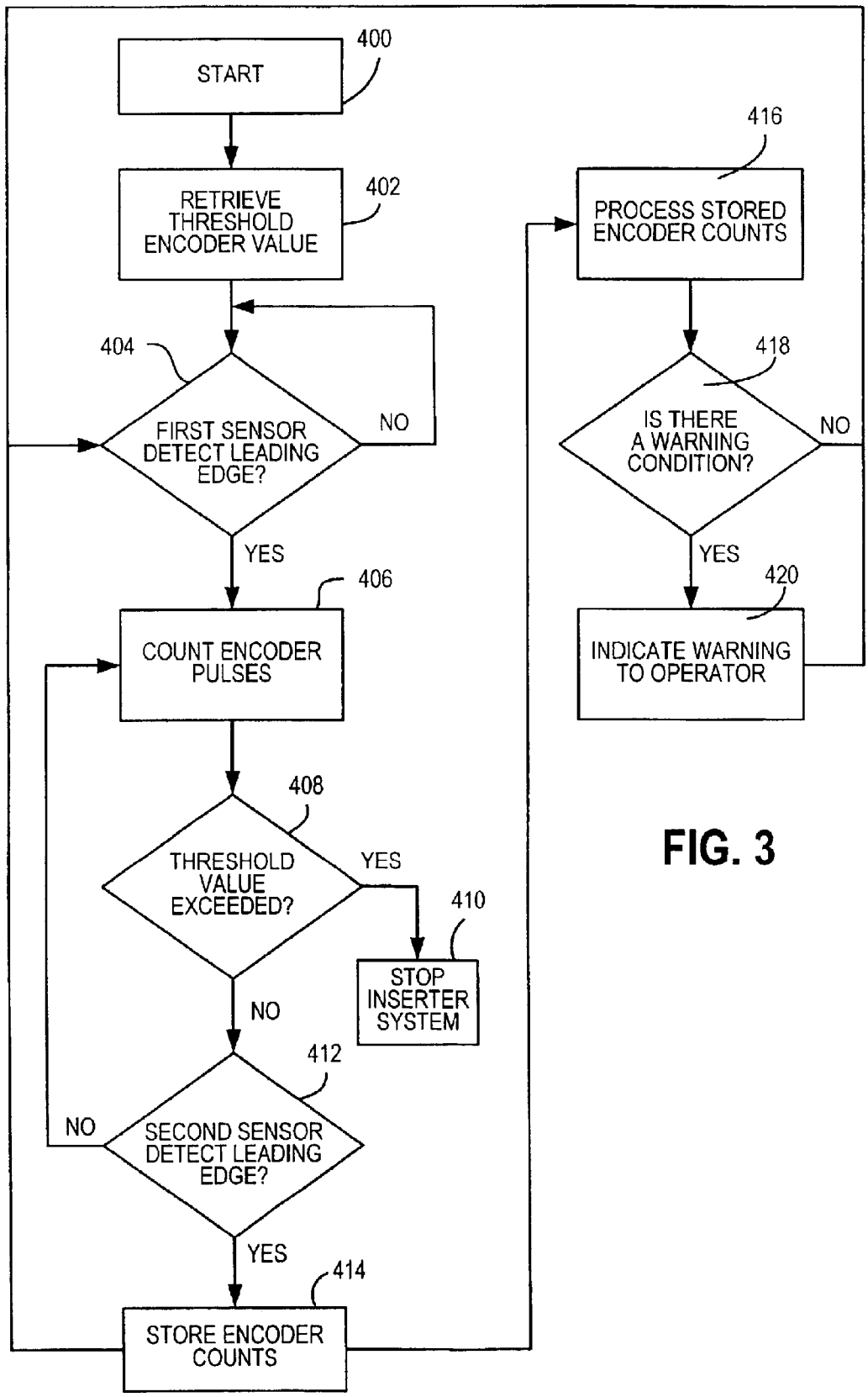
FIG. 3 is a flow chart depicting the diagnostic method of the present invention.

Turning now to the flowchart of FIG. 3, the operation and methodology of the present invention will now be described. First, a predetermined reference threshold value (DT) is established for the number of encoder counts it takes a leading edge 222 of a document 220 to convey from the first sensor 208 to the second sensor 210. In accordance with the preferred embodiment of the present invention, DT=DN+DS, where DN is the expected encoder count it takes for the leading edge 222 of a document 220 to convey from the first sensor 208 to the second sensor 210 (as indicated by the distance "E") and DS is a value (in encoder counts) to allow for material slippage which may be experienced by the document 220 as it's leading edge 222 conveys from the first sensor 208 to the second sensor 210.

In use, preferably once operation of the inserter system 10 starts (step 400), the control system 100 retrieves the predetermined value for the aforesaid threshold value (DT) (step 402), which may be adjusted from time to time by a user depending upon the operating parameters required for a specific job task to be performed by the inserter system 10. First, a determination is made as to whether the first sensor 208 detects a leading edge 222 of a document (step 404). If yes, the control system 100 counts the number of encoder pulses corresponding to rotation of drive roller 222 once the leading edge 222 of the document 220 conveys past the first sensor 208 (DC) (step 406). A determination is then made as to whether the encoder count (DC) exceeds the threshold value (DT) prior to the second sensor 210 detecting the lead edge 222 of the document 220 (step 408). If yes, then the control system 100 preferably causes a signal to be conveyed to an operator (step 410) and preferably causes stoppage of the inserter system 10 to prevent damage occurring to the inserter system 10 and/or documents being processed in the inserter system 10. This is because the document 220 is taking too much time conveying between the first and second sensors 208, 210 (as the threshold value (DT) as already been exceeded) indicating a malfunction condition is present in the inserter system 10 requiring operator attention.

If the encoder count (DC) does not exceed the threshold value (DT) a determination is then made as to whether the second sensor 210 has detected the leading edge 222 of a document 220 (step 412). If no, the encoder count (DC) is continued (step 406) and the above process therefrom is repeated. If yes, meaning the second sensor 210 detects the leading edge 222 of a document 220 before the encoder count (DC) exceeds the threshold value (DT), the control system 100 then categorizes the document 220 has arrived at the second sensor 210 within a permitted time period (e.g., less than DT) and the encoder count (DC) is stop and stored as a saved encoder code (DA) for further processing as described below (step 414).

Next, the latest recorded encoder count (DA) and all previous generated encoder counts are processed by the control system 100 for providing diagnostic information regarding the inserter system 10 (step 416). It is to be appreciated that various types of data processing may be performed regarding the aforesaid stored encoder counts, including, but not limited to, computing the: Mode, Average and Standard Deviation for the stored encoder counts. It is to be appreciated that the aforesaid processing for the stored encoder counts may be configured in various formats, such as comparing the Mode (the most frequently occurring encoder count (DA) value) to the expected encoder count time (DN). And, should the difference in these compared values be more than a predetermined amount (e.g., 10 encoder counts) (step 418), a warning message is caused to be conveyed from the control system 100 to an operator of the inserter system 10 indicating that actual (e.g., real time) operation has deviated significantly from the nominal indicating a potential problem in relevant portion of the inserter system 10 being monitored (step 420) while continuing to permit the inserter system to operate.

Figure 4A:
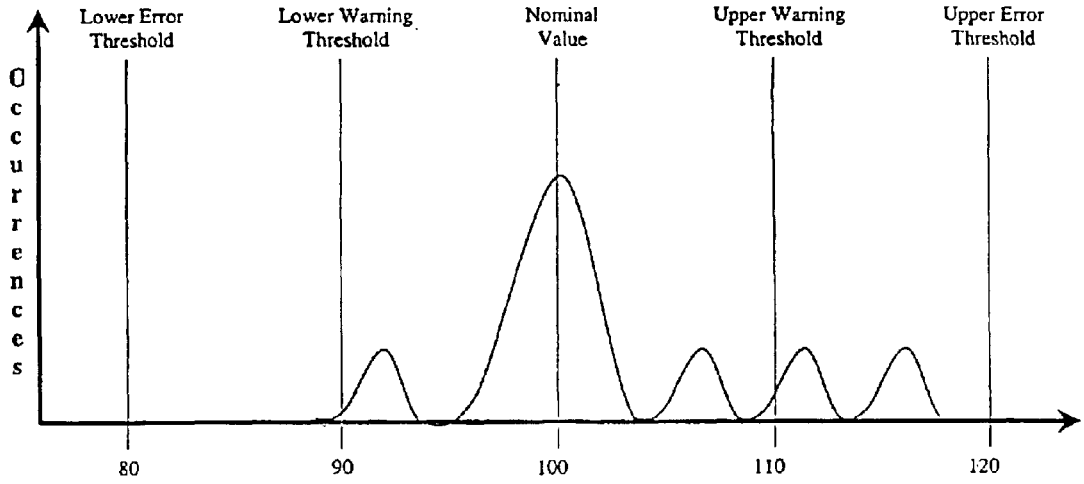
FIGS. 4A, 4B and 4C are diagnostic charts provided by the method of the present invention.
Figure 4B:
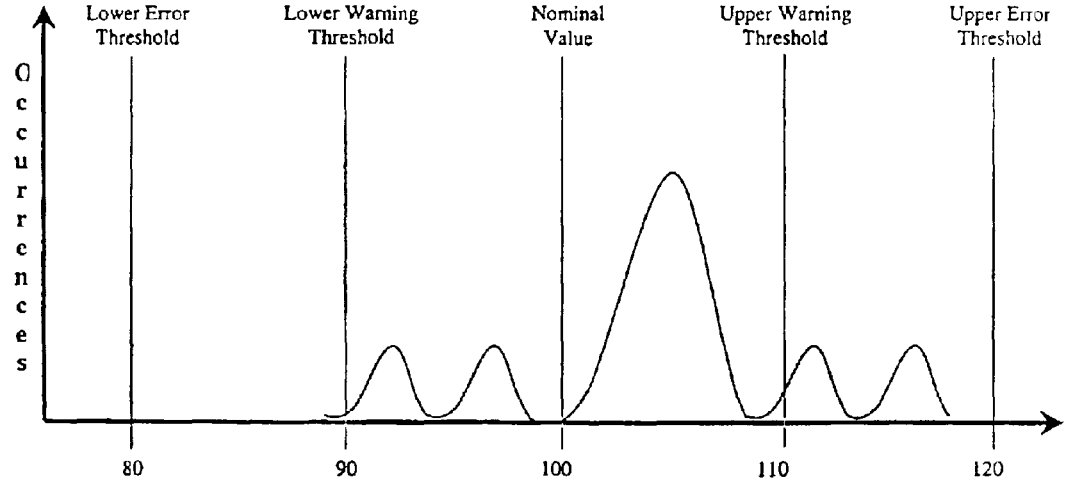
Figure 4C:
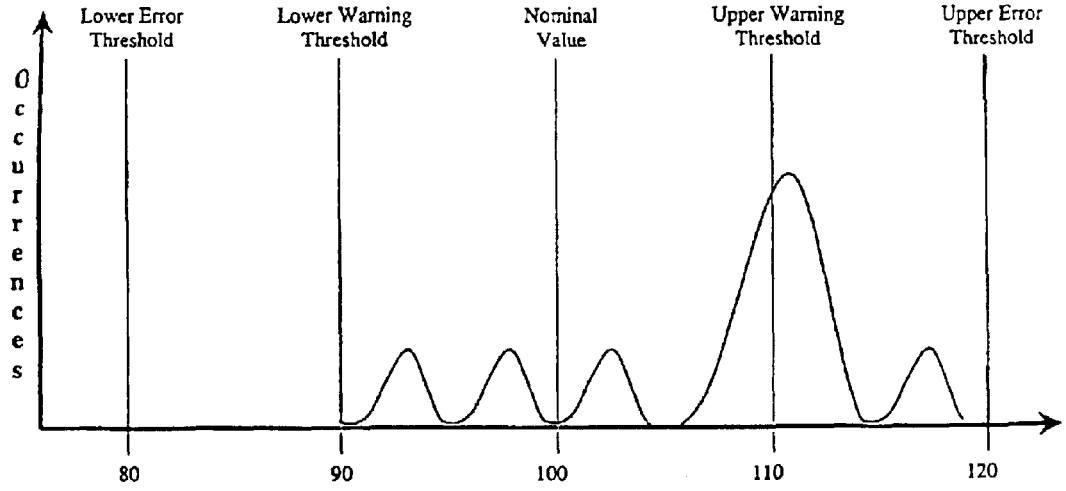

For example, and with reference now to FIGS. 4A, 4B and 4C, graphs are shown depicting exemplary distributions for stored encoder counts (DA). In regards to the exemplary illustrations of FIGS. 3A, 3B and 3C, the expected encoder value (DN) is 100 counts with threshold encoder warning values being prescribed at +/−10 encoder counts and having upper and lower threshold value limits (DT) being prescribed at +/−20 encoder counts. Therefore, warnings are generated when the mode of distribution exceeds +/−10 encoder counts, and in instances when an encoder count (DA) exceeds the threshold value (DT) (e.g., +/−20 encoder counts), the inserter system 10 is preferably caused to immediately stop via the control system 100.

With specific reference to FIG. 4A, there is shown a diagnostic chart depicting the operation of an inserter system operating in a good condition wherein the majority of the sampled encoder counts (DA) are clustered around the nominal threshold value (DN). FIG. 4B illustrates a diagnostic chart depicting operation of an inserter system that while it may be operating correctly, it is not within optimal performance since the difference between the Mode value for the encoder counts (DA) and the nominal threshold value (DN) is an indication of the performance of the inserter system 10, or at least the component of the inserter system 10 that is being monitored. Referring now to FIG. 4C, there is illustrated a diagnostic chart depicting operation of an inserter system 10 operating out of specification, whereby while it is still permitted to function (the threshold value (DT) has not yet been exceeded), it is functioning in a degraded mode since the Mode value for the encoder counts (DA) is greater than the aforesaid upper threshold value (e.g., 110 encoder counts) and a warning message is caused to be generated by the control system 100 to an operator indicating that the inserter system 10, or a specific component of the inserter system 10 requires attention.

It is to be particularly appreciated that the present invention diagnostic system made be used for many machine events occurring in an inserter system 10 so that it simultaneously monitors each event, while the inserter system 10 is operating, thus all areas of an inserter system 10 may be monitored simultaneously with warnings be provided when a particular inserter component is operating outside of the aforesaid threshold values. Additionally, an inserter system operator may selectively choose a diagnostic chart for a selected component of the inserter system 10 to view its current operating performance state. Further, while the preferred embodiment of the invention makes reference to tracking document movements by it's arrival at sensor 208 and 210, the present invention may make reference to tracking document movement by: document length (the lead edge 222 is detected by a first sensor 208 compared to the trail edge as detected by the second sensor 210); gap between documents 220 (e.g., trail edge of document 220 detected by the first sensor 208 and the lead edge of the next document is detected by the same first sensor 208; and arrival skew/departure skew (e.g., two sensors are mounted perpendicular to the direction of the normal document path such that by comparing the normal detection of the lead and trailing edges of a document, the skew of the material can be computed.

It is further to be appreciated that the present invention diagnostic system and method is not to be understood to be limited to use on an inserter system but may be used on type of device wherein there is real time comparisons between actual and expected operation, such as, voltage of power supplies (e.g., average voltage over time), pressure (e.g., average air-line pressure), temperature (average temperature), etc.

In summary, a method for providing diagnostic control of an inserter system has been described. Although the present invention has been described with emphasis on a particular embodiment, it should be understood that many changes and modifications may be made to the invention without departing from the scope and spirit of the invention as disclosed. For example, many modifications and adaptations to the preferred embodiment will be apparent to those skilled in the art. Further, those skilled in the art will appreciate that some aspects of the present invention will be used to advantage without the corresponding use of other aspects.

Accordingly, the foregoing description of the preferred embodiment should be considered as merely illustrative of the present invention and not in limitation thereof.

What is claimed is:

1. A system for providing diagnostic information relating to performance of an inserter system, said system including:

a roller arrangement positioned in said inserter system for causing a document to convey in a first direction and said roller arrangement having an encoder for providing an encoder count for each incremental movement caused to the document by the roller arrangement;

first and second sensors located in close proximity to said roller arrangement wherein the first sensor is located proximal to the roller arrangement and the second sensor is located distal to the roller arrangement relative to a document conveying in the first direction, each said first and second sensor being operable to detect at least the presence of a leading edge of a document conveying in close proximity to each said first and second sensor, respectfully;

a control system coupled to said first and second sensors and the roller arrangement and is operative to monitor and record the number of encoder counts it takes for a leading edge of a document to convey from said first sensor to said second sensor and compare said recorded number of encoder counts to a prescribed encoder count value and if the recorded encoder count value is greater than the prescribed encoder count value, said control system indicates a first warning condition to a user of said inserter system wherein the control system is further operable to monitor and store the number of encoder counts it takes for each of a plurality of documents to convey from said first sensor to said second sensor and provide statistically information based upon the stored encoder count values.

2. A system as recited in claim 1 wherein the first warning condition indicated to a user is the control system causes the inserter system to stop operation.

3. A system as recited in claim 1 wherein said statistically is chosen for the group consisting of the Mode, Average and Standard Deviation of at least some of said stored encoder counts.

4. A system as recited in claim 3 wherein said statistically information is provided in reference to said prescribed encoder count value.

5. A system as recited in claim 4 wherein said prescribed threshold encoder count value of said control system further includes a prescribed warning encoder count value that is less than said prescribed threshold encoder count value and said control system is operative to provide a second warning indication to a user of said inserter system if at least a portion of the determined statistically information has a value greater than said prescribed warning encoder count value.

* * * * *